US005533546A

United States Patent [19]

Dixon

[11] Patent Number: 5,533,546

[45] Date of Patent: Jul. 9, 1996

[54] ASSEMBLY FOR PREVENTION OF BACKFLOW IN VALVES

[75] Inventor: Lloyd J. Dixon, Brisbane, Australia

[73] Assignee: Valvtec Pty Limited, Queensland, Australia

[21] Appl. No.: 107,770

[22] PCT Filed: Feb. 26, 1992

[86] PCT No.: PCT/AU92/00082

§ 371 Date: Aug. 25, 1993

§ 102(e) Date: Aug. 25, 1993

[87] PCT Pub. No.: WO92/14954

PCT Pub. Date: Sep. 3, 1992

[30] Foreign Application Priority Data

Feb. 26, 1991 [AU] Australia ..... PK4822

[51] Int. Cl.[6] ..... F16K 24/00; E03C 1/10

[52] U.S. Cl. ..... 137/218; 137/217

[58] Field of Search ..... 137/217, 218

[56] References Cited

U.S. PATENT DOCUMENTS

| | | | |
|---|---|---|---|
| 2,133,804 | 10/1938 | Brooks . | |
| 2,259,984 | 10/1941 | Anderson . | |
| 3,416,556 | 12/1968 | Nelson . | |
| 3,470,898 | 10/1969 | Langdon | 137/218 |
| 3,713,457 | 1/1973 | McInnis et al. | 137/218 |
| 3,727,630 | 4/1973 | McInnis | 137/218 |
| 3,929,150 | 12/1975 | Flinner : | |

FOREIGN PATENT DOCUMENTS

| | | |
|---|---|---|
| 330599 | 12/1920 | Germany . |
| 395872 | 5/1924 | Germany . |
| 257204 | 3/1949 | Switzerland . |

*Primary Examiner*—Gerald A. Michalsky
*Attorney, Agent, or Firm*—Robbins, Berliner & Carson

[57] ABSTRACT

A valve assembly which is suitable for backflow prevention in a stop cock having an inlet, a seat and an outlet. The valve assembly may be attachable to the stop cock and includes a valve body having at least one opening and also including a valve chamber and a valve seat. There is provided a balance tube in the valve body which communicates with the valve chamber which has one end engaged with the stop cock seat for sealing against the seat for prevention of flow of fluid from inlet to outlet, a piston located within the valve body and engageable with the valve seat, and biasing means operable to unseat the piston from the valve seat to enable the outlet to communicate with the valve body opening. In a further embodiment the valve assembly also includes a third seat in the handle and a valve member biased open by a spring against inlet pressure to allow atmosphere air to break a vacuum at the inlet. The fundamental advantage of the valve assembly is that it can prevent backflow when the stop cock is opened or closed and may also be utilized when the downstream pressure exceeds the upstream pressure by a predetermined amount.

20 Claims, 5 Drawing Sheets

17
18
19
17A
19A
18A
14A
10A
16A
21
25
22
44A
32
30
15
26
42
40
47
44
45
46
20
41
24
43
23
24
46
16
31
34
11A
33
10
33A
11
12
13

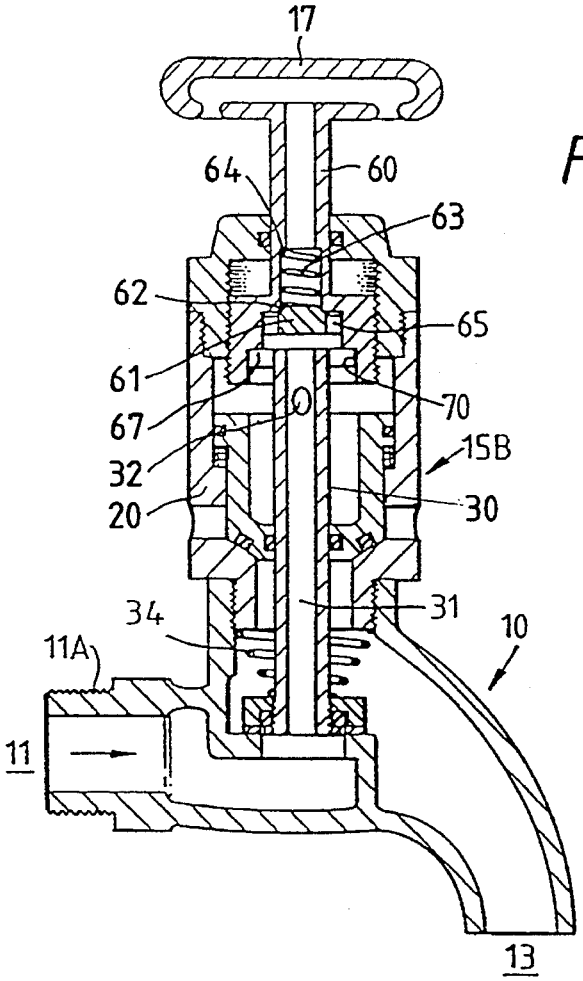
Fig.5.
Fig.6.
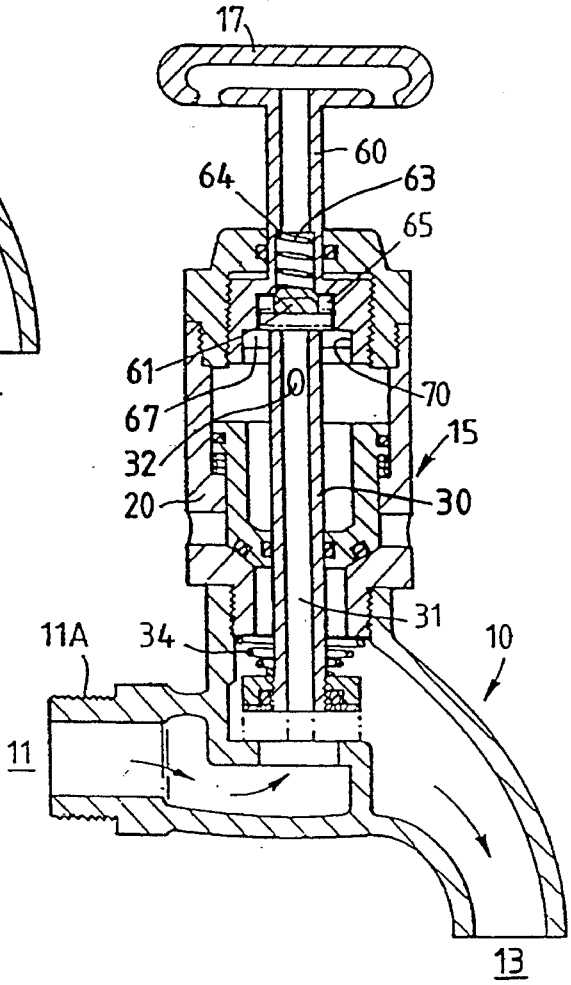
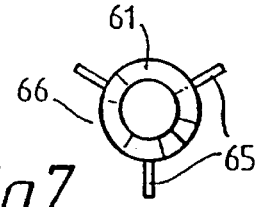
Fig.7.
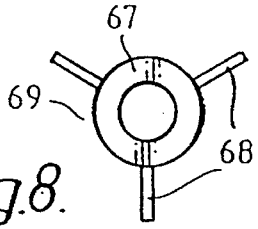
Fig.8.

ASSEMBLY FOR PREVENTION OF BACKFLOW IN VALVES

TECHNICAL FIELD

This invention relates to a valve assembly for prevention of backflow in taps and faucets generally and which is attachable to the tap or faucet.

The invention will be described by way of example with reference to stop cocks but it should be appreciated that the invention is not limited to just such an application. The valve of the invention may be used in other ways also. For example the valve of the invention may be used in relation to globe valves which include inline stop cocks.

BACKGROUND ART

A normal stop cock valve tap consists of a body with an inlet, an outlet, a valve seat between the inlet and outlet, a spindle with a handle and a valve member movable by the handle to either cause it to seal against the seat or release it for movement away from the seat.

With such valves there is no protection against backflow and harmful substances can travel into the supply line and contaminate liquid in the supply line which may exit from that of other valves coupled to the line.

Backflow prevention devices are known and these are either fitted upstream or downstream of the valve. Where the valve is a standard stop cock, downstream backflow prevention devices may either be fitted directly to the outlet of the stop cock or in a line attached to the outlet. Such devices can readily be removed and for this reason are undesirable.

Backflow prevention devices mounted upstream of the stop cock require fitting by a skilled tradesman and are difficult to retrofit.

Reference may also be made to Australian specification 68314/90 which describes a tap having the same construction as a conventional stop cock as described above which also includes a backflow preventer. In this arrangement an operator is connected to a valve closure member which opens and closes the flow passage between inlet and outlet. The backflow preventer comprises a tubular body having a flow path therethrough which is connected to the outlet and a non-return valve fitted within the tubular body. A vacuum break opening is formed in a wall of the tubular body and there is also provided a diaphragm to open the opening and permit communication between the atmosphere and the flow path when the pressure within the flow path is less than ambient pressure.

In Australian specification 69869/91 (EP441151) there is described a mixer tap with a shower head attachment which incorporates a venting device for preventing water from being drawn back via a hose connection between a housing of the mixer tap and shower head. There is provided a pair of valves inserted in a water feed for the shower head wherein each valve has a movable valve element displaced between two opposing valve seats respectively associated with a vent opening and a flow opening for the water feed. Each valve element is biased towards the valve seat associated with the water feed opening.

Australian specification 59050/90 describes a backflow preventer valve adopted to be fitted to a conventional tap or stopcock as described above. The valve has an inlet and outlet connected by one or more passages and an annular main valve member formed of flexible material which may move between a closed position when there is back flow through the valve and an open position when there is normal flow of liquid from upstream to downstream. One or more discharge passages connect to interior of the valve body to atmosphere on the downstream side of the main valve member. A spring loaded valve actuator closes the main valve member when there is a back flow from the downstream side and also closes the discharge passage(s) when there is a normal flow from upstream to downstream.

U.S. Pat. No. 4,969,483 describes an anti-siphon assembly especially for a shower mechanism which has an automatic flexible one way valve associated with a cover of a housing of the anti-siphon assembly. The cover has air intakes controlled by the one way valve. The valve has an elastic lip and remains closed while the pressure in a control valve of the shower mechanism is above atmospheric but opens as soon as the pressure drops below atmospheric in the control valve.

U.S. Pat. No. 4,909,270 describes an anti-siphon water backflow fitting which is fitted to a threaded neck portion of a faucet and which is adapted to receive a hose coupling. The fitting includes a pair of valves which are biased shut to prevent backflow of water into the faucet when a water source is turned off and which are open when the water source is turned on.

U.S. Pat. No. 4,804,010 describes a sink faucet assembly with an anti-siphon assembly forming a clamp for a sink deck.

U.S. Pat. No. 4,726,390 describes a faucet hose bib vacuum breaker or backflow preventer which includes a web with multiple vent holes and a peripherally supporting flexible resilient diaphragm and overlying plate.

U.S. Pat. No. 4,712,575 describes a self draining hose connection vacuum breaker which has a movable piston with two different positions dependent on whether or not the hose is fitted.

U.S. Pat. No. 4,712,574 describes a vacuum breaking valve for a pressurised fluid line which has a pipe tapped into a line upstream of an outlet terminating in a ball shaped housing. The housing receives a check valve including a movable diaphragm arranged for ensuring that fluid does not escape during normal operation of the line but admits vacuum breaking air in the event of line pressure loss.

U.S. Pat. No. 4,700,732 refers to a faucet drain preventing damage due to freezing having a lightly sprung ball valve allowing trapped water to drain when pressure is released.

U.S. Pat. No. 4,827,538 describes a mixing tap for a sink which has a mixing chamber with a relief valve located in a wall of the mixing chamber which is responsive to negative pressure. The relief valve comprises a closure member which is forced into a closed position by gravity and/or a spring.

U.S. Pat. Nos. 4,696,322 and 4,805,661 refers to a faucet back flow preventer valve assembly which includes a control valve housing which has a valve member comprising a ball with ports for selectively uncovering or covering a supply inlet and outlet. A check valve is mounted in an anti-siphon passageway within the ball and allows air into the ball from an auxiliary opening which communicates with atmosphere and hence into the supply inlet if negative pressure exists.

U.S. Pat. No. 4,669,497 refers to a water faucet backflow preventer assembly which includes a tubular body having a flow passageway having an inlet and outlet. The flow passageway includes an integral shoulder and a pair of exhaust ports upstream of the shoulder. A valve assembly located within the passageway is spring biased into a seated position closing communication between the outlet and inlet while permitting fluid communication between the outlet and the discharge ports for draining any reverse water flow. The valve assembly is yieldable to an operating position under the force of pressurised fluid flow into the inlet and to open communication with the outlet. A resilient valve washer contacts the integral shoulder to close communication between the passageway and the discharge ports to prevent water leakage.

United Kingdom specification 1602193 refers to an anti-siphoning device having a domed closure urged by atmospheric pressure to seal a mating aperture. The device is fitted into a garden water tap operated by a handle, a spindle and an outlet and is mounted in the outlet.

U.S. Pat. No. 4,134,419 refers to a combination faucet and anti-siphon valve having a body with two effluent inlets communicating with single outlet and central drinking water dispensing tube.

Having regard to the prior art described above which was located in an international search carried out in respect of the invention it will be appreciated that such prior art valve assemblies for preventing anti-syphoning or prevention of backflow were found to be deficient in operation because of their inability to operate effectively when installed in stop cocks or taps when the stop cock or tap was open or closed.

DISCLOSURE OF THE INVENTION

It therefore is an objection of the invention to provide a valve assembly which in operation and when installed in a stop cock may prevent backflow when the stop cock is open or closed.

The valve assembly of the invention is therefore attachable to a stop cock having an inlet, a seat, and an outlet, the valve assembly including:

a valve body having at least one opening and also including a valve chamber and a valve seat; a balance tube in the valve body communicating with the valve chamber and having one end engageable with the stop cock seat in use for sealing against the seat for prevention of flow of fluid from inlet to outlet;

a piston within the valve body and engageable with the valve seat; and biasing means operable to unseat the piston from the valve seat to enable the outlet to communicate with the valve body opening.

The piston preferably has a bore through which the balance tube may pass. Preferably the bore is centrally located relative to the piston and extends longitudinally of the body. The bore may be sealed relative to the balance tube. Preferably at least one piston seal is employed. More preferably, two spaced piston seals are employed.

The biasing means biasing the piston from the valve seat is preferably a spring. The spring may extend between the body and the piston. Preferably the spring extends between a shoulder in the body and the piston. The spring may be a coil spring.

The chamber is preferably at one end of the body and spaced from the valve seat.

The balance tube may be provided with an aperture for communicating with the chamber. The aperture preferably is adjacent one end of the tube and laterally of the tube.

The balance tube may be free to move against the seat in the stop cock under the influence of gravity. The tube may be moved away from that seat by fluid pressure at the inlet of the stop cock. Preferably biasing means is employed to bias the tube against the seat in the stop cock and inlet pressure may move the tube away from the seat against the action of the biasing means.

The biasing means biasing the balance tube is preferably a spring, a coil spring is preferred. The spring may extend between the tube and the body.

Preferably two openings are present in the body. The openings may be diametrically opposed.

The body may include a stop for limiting the movement of the piston. The stop may project laterally of the body preferably the stop extends through a wall of the body and consists of a fastener.

There also may be provided an air vent or inlet so that the valve body may be open to atmospheric pressure. The air inlet may be located in the stop cock handle if required or the stop cock body or valve body.

BRIEF DESCRIPTION OF THE DRAWINGS

A particular preferred valve assembly will now be described by way of example with reference to the drawings in which:

FIG. 5 is a sectional view of a third embodiment of valve assembly constructed in accordance with the invention, wherein the stop cock is in the closed position;

FIG. 6 is a similar view to FIG. 5 but showing the stop cock in the open position;

FIG. 7 is a plan view of a sliding seal used in the embodiment of FIG. 5; and FIG. 8 is a plan view of a balance tube guide member used in the embodiment of FIG. 5.

DESCRIPTION OF PREFERRED EMBODIMENTS OF THE INVENTION

Figure 1:
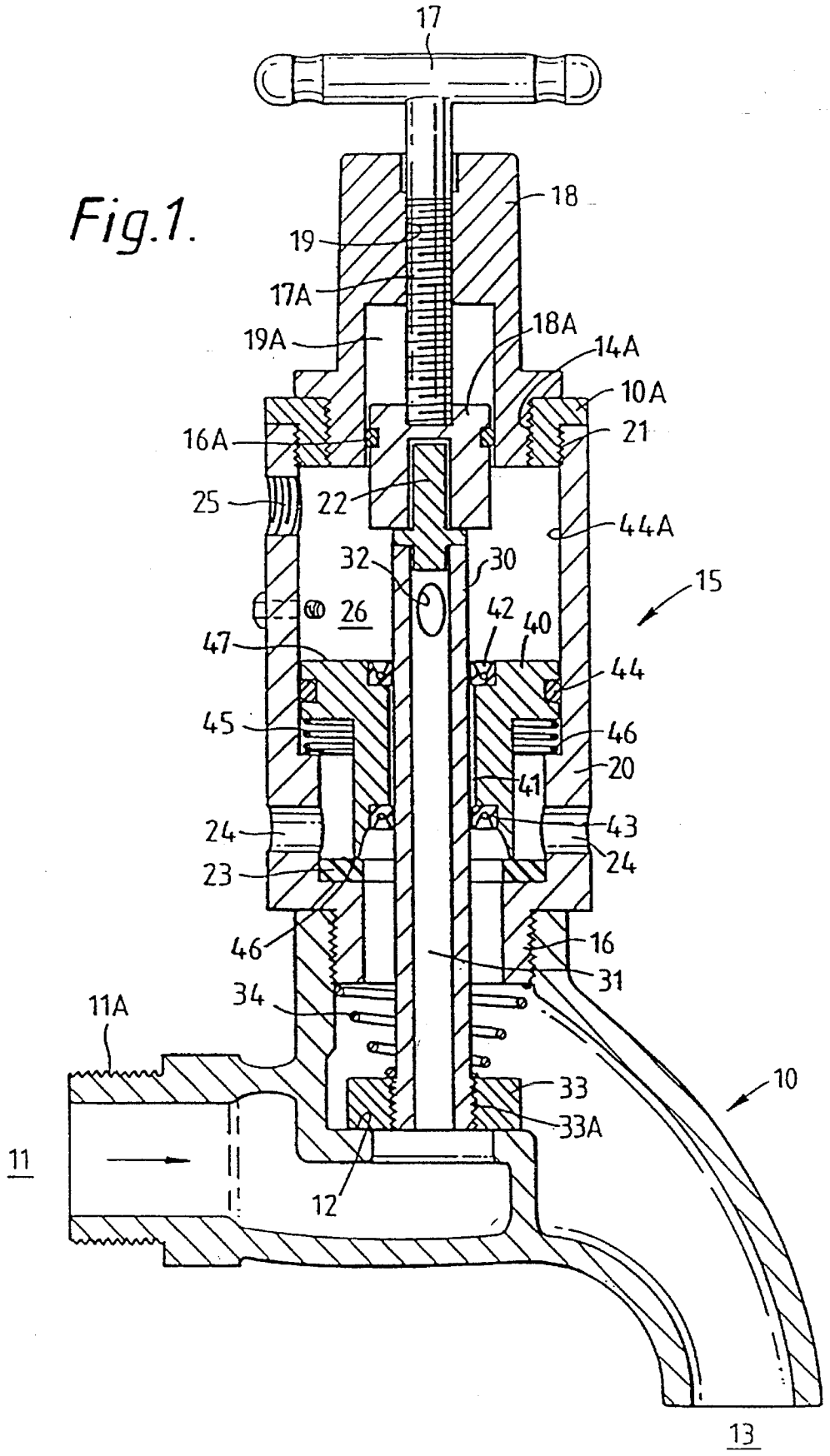
FIG. 1 is a sectional view of a valve assembly according to the invention shown fitted to a stop cock and in the closed position.

In FIG. 1 there is shown a stop cock 10 which may operate as a hose tap or faucet which may be used in gardens, laboratories, swimming pools, caravan parks, hairdressing salons or for use in sinks in kitchens. The stop cock 10 includes an inlet 11 having a thread 11A attachable to an inlet pipe (not shown), a seat 12 and inlet 13 which are all standard features of a conventional stop cock. A valve assembly 15 constructed in accordance with the invention is screw fitted into the stop cock 10 at 16. The stop cock 10 also includes handle 17 which has a spindle 17A screw threadedly engaged with bonnet 18 at 19. There is also provided an extension 18A of spindle 17A which is located in recess 19A of bonnet 18. Extension 18A is provided with a seal 16A for movement within recess 19A as spindle 17A is rotated from a closed position shown in FIG. 1 to an open position shown in FIG. 2. There is also provided a bush 10A which is screw threadedly attached to bonnet 18 at 14A and also screw threadedly attached to valve body 20 of valve assembly 15 at 21.

The valve assembly 15 also includes seal 23 for providing a valve seat. Diametrically opposed openings 24 are also located in valve body 20. Opening 25 extends through the side wall of body 20 and communicates with valve chamber 26. Opening 25 may be open to atmosphere or may be closed off by a plug (not shown). Opening 25 may be used to test valve assembly 15.

Balance tube 30 is located within valve body 20 and has an internal passage 31. There is also provided a guide member 22 for guiding movement of balance tube 30. Guide member 22 is fixed to an upper end of balance tube 30 by screw threaded engagement. Lateral port 32 adjacent one end of balance tube 30 enables passage 31 to communicate with valve chamber 26. A lower end of the tube 30 terminates in a resilient member 33 for seating against seat 12. Resilient member 33 is screw threadedly engaged with tube 30 at 33A. A spring 34 is located between tube 30 and body 20 and biases the tube 30 towards the seat 12.

Piston 40 has a bore 41 through which the tube 30 passes. Seals 42 and 43, seal piston 40 against the tube 30 for relative sliding movement. Seal 44 seals the piston 40 against an internal surface 44A of valve body 20. Spring 45 extends between the piston 40 and a shoulder 46 in valve body 20 and normally biases the piston away from seal 23.

The operation of the valve assembly 15 will now be described.

In FIG. 1 the spindle 17A has been operated to move the tube 30 against seat 12. The valve assembly 15 is in the closed position. Fluid entering the inlet 11 does not exit from the outlet 13 but is free to communicate with chamber 26 via passage 31 and aperture 32. Subject to any back pressure at the outlet 13 the piston 40 is held in the FIG. 1 position against the action of spring 45 and abuts the seal 23. In this position venting through openings 24 does not occur.

Figure 2:
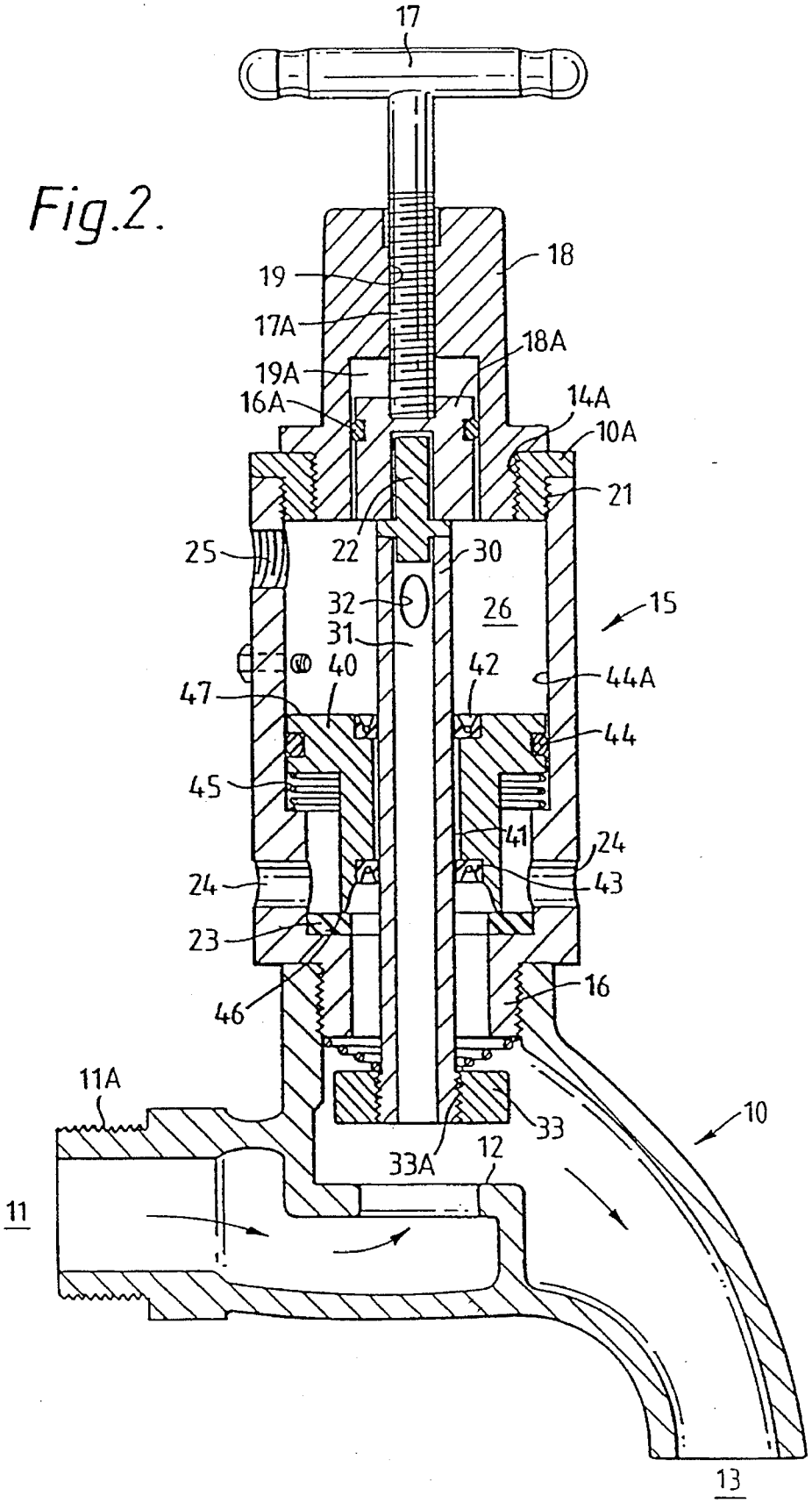
FIG. 2 is a sectional view like that of FIG. 1 but with the valve in the open position.

FIG. 2 shows the valve assembly 15 in its open position with the tube 30 unseated from seat 12. Fluid may flow from the inlet 11 to the outlet 13. Also this fluid communicates with chamber 26 to maintain the piston 40 against seal 23.

Figure 3:
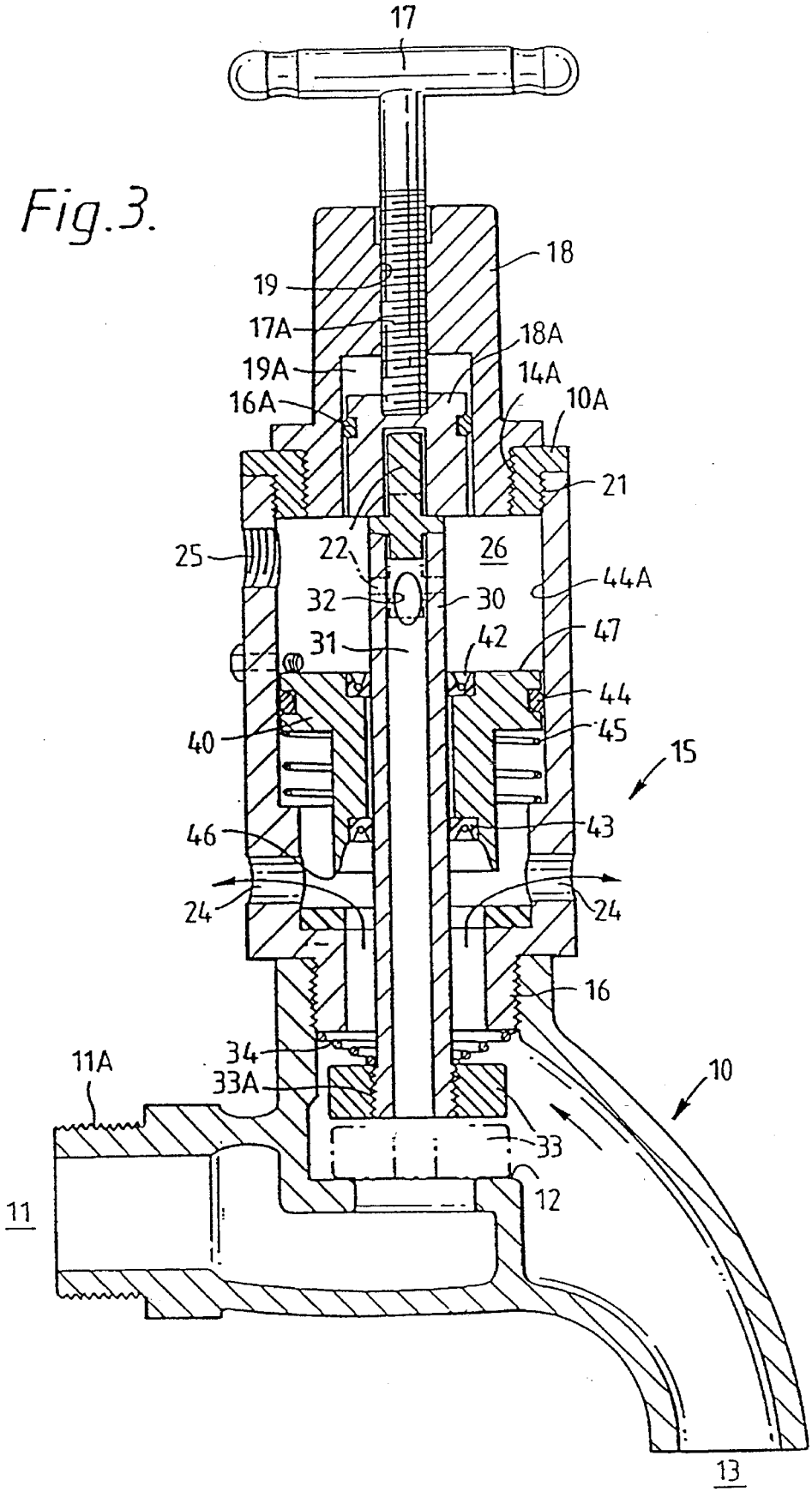
FIG. 3 is a sectional view of the valve assembly shown in a venting position preventing backflow.

In the event of loss of fluid pressure to the inlet 11, the pressure in the chamber 26 decreases. Spring 45 forces the piston 40 away from seal 23 to vent the valve body 20 to thereby break the syphoning effect from the outlet 13 to the inlet 11. This is shown in FIG. 3. When the inlet pressure drops spring 34 ensures that the end of tube 30 engages the seat 12 shown in phantom in FIG. 3 thereby preventing further backflow from the outlet to the inlet of the stop cock 10.

The valve assembly 15 of the invention shown in FIGS. 1–3 functions such that the supply pressure controls the valve venting through the vent apertures 24 both when the valve is open and closed.

Figure 4:
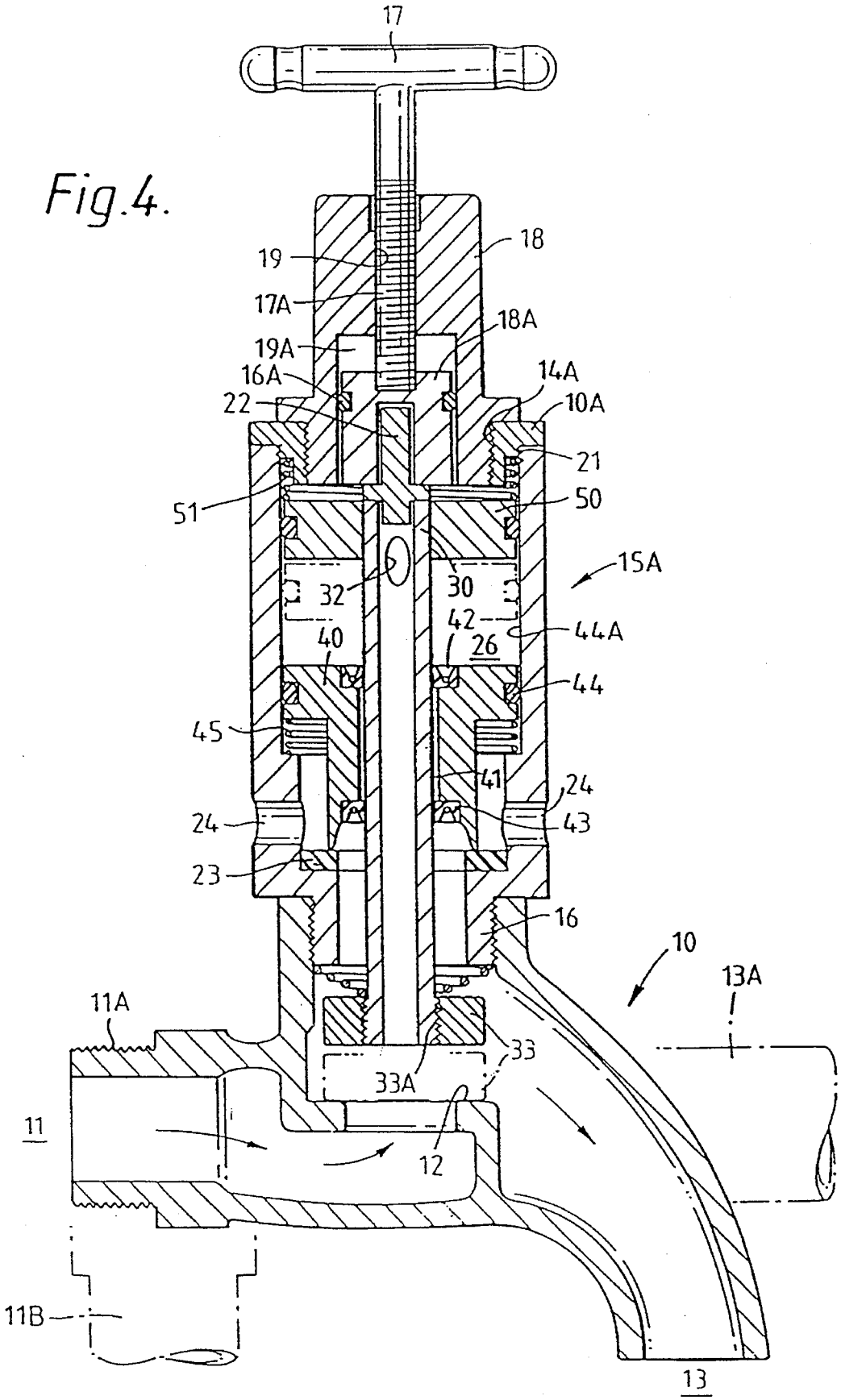
FIG. 4 is a sectional view of a second embodiment of valve assembly constructed in accordance with the invention.

In FIG. 4 there is shown another valve assembly 10A in accordance with the invention. In this arrangement there is also provided a flange 50 and a balance pipe return spring 51. In the closed position shown in phantom in FIG. 4 water may enter the balance tube 30 and into valve chamber 26 through port 32. Water pressure may push the piston 40 down against the spring 45 so that the piston engages seal 23. Water pressure also forces the flange 50 up against the balance pipe return spring 51.

In the open position shown in full outline in FIG. 4 when the stop cock 10 is opened under mains pressure the balance tube 30 follows spindle 17A up to the fully open position. When the stop cock 10 remains open under pressure, the balance tube 30 and the seal 33 remain in the raised position regardless of downstream flow or no flow conditions. The provision of flange 50 therefore saves excessive wear and tear on seal 33 and seat 12.

In FIG. 4 in the event of loss of supply pressure, water above the piston drains through port 32 and the spring 45 forces the piston 40 upwardly and opens the air vents 24. The return spring 51 forces the seal 33 to contact seat 12. In this position therefore no backflow can occur and excess downstream pressure is released through air vents 24 and air is allowed to enter and prevent back siphonage.

It will be appreciated that the embodiment of FIG. 4 is mainly applicable to an inline situation whereby inlet 11B shown in phantom may be utilised instead of inlet 11. There is also shown outlet 13A which may be utilised in substitution of outlet 13 which is applicable to stop cock 10.

In FIGS. 5–6 a modified valve assembly 15B is shown in accordance with the invention. In this arrangement there is shown an air inlet 60 in handle 17 and spindle 17A. There is also included a floating seal 61 which locates against seat 62. A spring 63 is located in air inlet 60 and retained in position by shoulder 64. Floating or sliding seal 61 is provided with a plurality of arms 65 allowing air to pass through gaps 66 between adjacent arms 65.

The balance tube 30 is also provided with an upper fixed guide 67 which also has a plurality of arms 68 and gaps 69 located between adjacent arms 68. Guide 67 locates against shoulder 70.

Thus in operation of the arrangement shown in FIGS. 5–6 mains pressure forces sliding seal 61 against seat 62. The seal 61 is suitably made from plastics material of a relatively light weight. The balance tube 30 is retained against shoulder 70.

The presence of negative pressure causes the sliding seal 61 to open air inlet 60 assisted by the bias of spring 63. Air may then enter chamber 26 through gaps 66 in seal 61 and gaps 69 in guide 67 of balance tube 30 and thence through port 32. This will enable the valve assembly 15B by opening of air vent or air inlet 60 to automatically prevent a vacuum or source of negative pressure occurring upstream of valve assembly 15B. This is in contrast to valve assembly 15 shown in FIGS. 1–3 and valve assembly 10A shown in FIG. 4 wherein a vacuum or source of negative pressure will have already formed prior to elimination of the -vacuum as previously described in relation to valve assemblies 15 and 10A.

It will also be appreciated from the above in each of the three embodiments described the valve assembly of the invention will operate whether the stop cock 10 is in the closed or open position. Thus when the stop cock 10 is closed and balance tube 30 is in contact with seal 12 the piston 40 will rise in the case of negative pressure upstream by virtue of the bias of spring 45 so that the pressure can be relieved through air vents 24 as previously described. In other words the source of negative pressure upstream will cause a pressure drop which will be experienced by valve chamber 26 being in communication with inlet 11 by virtue of passage 31 and port 32. When the stop cock 10 is open the source of negative pressure upstream in inlet 11 will also be relieved or prevented as previously described.

It will also be appreciated that the valve assembly of the invention can operate effectively in the situation where downstream pressure will exceed upstream pressure by a predetermined or precalibrated amount. In this situation the balance tube 30 will remain in contact with seat 12 and elevation of piston 40 will occur through the bias of spring 45. This occurs by virtue of the pressure on the underside of the piston 40 (is the area defined by an annulus between sealing edges 46) which is normally exceeded by the upstream pressure which is exerted on the top surface 47 of piston 40 (which surface area is greater than the surface area of the abovementioned annulus) will then exceed the upstream pressure and thus cause elevation of piston 40. It therefore will be appreciated that the predetermined or precalibrated amount will be directly proportioned to the respective surface areas of the underside annulus and top surface 47 of piston 40. This is a unique property of valve assemblies constructed in accordance with the invention which is not realised by conventional backflow prevention valve assemblies referred to above.

It therefore will be appreciated from the foregoing that the invention is applicable to taps and faucets generally and in particular in regard to stop cocks which may be used to connect hoses thereto such as for use in swimming pools, laboratory sinks, public toilets, public buildings, factories, caravan parks and also in relation to irrigation where hose taps or faucets or hose stop cocks are required.

The invention is also applicable to inline situations covering stop cocks or taps for use in dishwashers, washing machines, water softeners and other appropriate situations.

It will also be appreciated by the person skilled in the art that the advantages of the valve assembly of the invention in contrast to the prior art will include the following:

1. Low cost
2. Can be retrofitted to all conventional taps or faucets.
3. Can be adapted to globe valves of all sizes.
4. Can be constructed in an alternate form such as a testable device and used in conjunction with a check valve as a low cost higher security device.
5. Has low pressure loss characteristics.
6. Does not constantly leak to atmosphere during operation.
7. Downstream liquids may be released to atmosphere when upstream pressure is exceeded by downstream pressure ie. to a predetermined degree of excess pressure.
8. May be essentially controlled by upstream pressure and allows the ingress of air, upstream and downstream separately and in isolation from each other.
9. Is not easily removed as an inconvenience.
10. May operate when a stop cock is opened or closed.

I claim:

1. A valve assembly suitable for backflow prevention in a stop cock having an inlet, a stop cock seat and an outlet and attachable thereto, the valve assembly including:

a valve body having at least one opening and also including a valve chamber and a valve seat; a balance tube in the valve body communicating with the valve chamber and having one end engageable with the stop cock seat in use for sealing against the stop cock seat for prevention of flow of fluid from inlet to outlet, wherein the balance tube is free to move against the stop cock seat under the influence of gravity;

a piston within the valve body and engageable with the valve seat; and biasing means operable to unseat the piston from the valve seat to enable the outlet to communicate with the valve body opening.

2. A valve assembly as claimed in claim 1 wherein the piston is provided with a bore through which the balance tube may pass.

3. A valve assembly as claimed in claim 2 wherein the bore is sealed relative to the balance tube.

4. A valve assembly as claimed in claim 1 wherein there is provided biasing means biasing the balance tube away from the stop cock seat in use.

5. A valve assembly as claimed in claim 1 wherein the balance tube is provided with an aperture for fluid communication with the valve chamber.

6. A valve assembly as claimed in claim 5 wherein the aperture is located adjacent an end of the balance tube remote from said one end.

7. A valve assembly as claimed in claim 1 wherein the said at least one opening of the valve body is located adjacent a lower end of a side wall of the valve body in use.

8. A valve assembly as claimed in claim 7 wherein there is provided a pair of openings in the valve body diametrically opposite to each other.

9. A valve assembly as claimed in claim 1 wherein said balance tube is provided with a flange intermediate each end thereof and located upwardly of the piston in use.

10. A valve assembly as claimed in claim 9 wherein there is provided biasing means for biasing said flange downwardly in use.

11. A valve assembly as claimed in claim 1 wherein the valve chamber is provided with an air vent above the piston which is open to atmosphere.

12. A valve assembly as claimed in claim 11 wherein there is provided a sliding seal in the valve chamber for closing said air vent during normal operation of the stop cock.

13. A valve assembly as claimed in claim 12 wherein the sliding seal has at least one air port for passage of air when the air vent is opened.

14. A valve assembly as claimed in claim 12 wherein there is provided biasing means for biasing the sliding seal away from a mating seat to open the air vent.

15. A valve assembly as claimed in claim 13 wherein the balance tube is provided with a guide member adjacent an upper end in use having at least one air port for passage of air when the air vent is open.

16. A valve assembly suitable for backflow prevention in a stop cock comprising an inlet, a stop cock seat, and an outlet and attachable thereto, the valve assembly including a valve body comprising:

(i) at least one opening in a side wall of the valve body and adjacent a lower end thereof in use;

(ii) a valve chamber; and (iii) a valve seat;

a balance tube in the valve body provided with an aperture for fluid communication with the valve chamber, said balance tube being free to move against the stop cock seat under the influence of gravity and having one end sealingly engageable with the stop cock seat in use for prevention of flow of liquid from inlet to outlet and there also being provided biasing means biasing the balance tube away from the stop cock seat in use;

a piston within the valve body which is engageable with the valve seat, said piston being provided with a bore through which the balance tube may pass wherein the bore is sealed relative to the balance tube; and biasing means operable to unseat the piston from the valve seat to enable the outlet to communicate with the valve body opening.

17. A valve assembly as claimed in claim 16 wherein the aperture is located adjacent an end of the balance tube remote from said end.

18. A valve assembly as claimed in claim 16 wherein there is provided a pair of openings in the valve body diametrically opposite to each other.

19. A stop cock assembly comprising:

a stop cock having an inlet, a stop cock seat and an outlet;

a valve assembly attachable to the stop cock, said valve assembly including a valve body comprising:

(i) at least one opening in a side wall of the valve body and adjacent a lower end thereof;

(ii) a valve chamber; and (iii) a valve seat;

a balance tube in the valve body provided with an aperture for fluid communication with the valve chamber, said balance tube being free to move against the stop cock seat under the influence of gravity and having one end sealingly engageable with the stop cock seat in use for prevention of flow of liquid from inlet to outlet and there also being provided biasing means biasing the balance tube away from the stop cock seat in use;

a piston within the valve body which is engageable with the valve seat, and piston being provided with a bore through which the balance tube may pass wherein the bore is sealed relative to the balance tube; and biasing means operable to unseat the piston from the valve seat to enable the outlet to communicate with the valve body opening.

20. A stop cock assembly as claimed in claim 19 wherein the stop cock is an existing stop cock.

* * * * *